US012577035B1

(12) United States Patent
Grafer

(10) Patent No.: US 12,577,035 B1
(45) Date of Patent: Mar. 17, 2026

(54) WIRE CADDY

(71) Applicant: George Scott Grafer, Huntley, IL (US)

(72) Inventor: George Scott Grafer, Huntley, IL (US)

( * ) Notice: Subject to any disclaimer, the term of this patent is extended or adjusted under 35 U.S.C. 154(b) by 0 days.

(21) Appl. No.: 18/638,497

(22) Filed: Apr. 17, 2024

Related U.S. Application Data

(60) Provisional application No. 63/465,755, filed on May 11, 2023.

(51) Int. Cl.
*B65D 85/04* (2006.01)
*B65H 75/44* (2006.01)

(52) U.S. Cl.
CPC ..... *B65D 85/04* (2013.01); *B65H 75/4471* (2013.01); *B65H 2701/34* (2013.01)

(58) Field of Classification Search
CPC ..... B65D 85/04; B65H 16/02; B65H 21/02; B65H 49/32; B65H 75/40; B65H 75/44; B65H 75/4471; B65H 75/65; B65H 2701/34
USPC ..... 206/391; 242/160.2, 160.3, 160.4, 166, 242/170, 171, 588.3, 594.2, 594.3, 594.4, 242/598.3; 248/127
See application file for complete search history.

(56) References Cited

U.S. PATENT DOCUMENTS 4,669,681 A * 6/1987 Hansen ..... B65H 49/322 242/132
5,634,610 A * 6/1997 Walsh ..... B65H 49/32 242/422.4
5,687,928 A * 11/1997 Lassiter ..... B65H 49/24 242/588
7,320,445 B2 * 1/2008 Eastwood ..... B65H 49/322 242/598.6
7,931,227 B1 * 4/2011 Oudekerk ..... H02G 1/08 242/594.3
8,016,222 B2 * 9/2011 Galgano ..... B62B 3/04 242/594.3
8,424,795 B2 * 4/2013 Galgano ..... B65H 49/32 242/598.5
2012/0318939 A1 * 12/2012 Galgano ..... B65H 49/328 242/598.3

* cited by examiner

*Primary Examiner* — Bryon P Gehman
(74) *Attorney, Agent, or Firm* — UNDERWOOD & ASSOCIATES, LLC

(57) ABSTRACT

A wire caddy assembly includes a storage vessel framework formed of a lightweight, resilient material, the framework including a floor, and first, second, third and fourth wall members extending perpendicularly from the floor. The assembly further includes at least one support feature for supporting a cross bar between opposing first and second of the walls of the vessel framework, at least one aperture within the third or fourth wall, and a handle grip formed on each of the first, second, third and fourth walls.

13 Claims, 5 Drawing Sheets

WIRE CADDY

REFERENCE TO RELATED APPLICATIONS

This application claims priority to and the benefit under 35 USC § 119 (e) of U.S. Provisional Patent Application No. 63/465,755, filed on May 11, 2023, the contents of which is fully incorporated by reference in its entirety as if fully set forth herein.

TECHNICAL FIELD

This disclosure relates to systems and methods for transporting one or more spools of electrical wire in a compact, organized container. In particular, this disclosure relates to a wire caddy, which is stackable with other wire caddies of the same or similar design, that allows storage of one or more spools of electrical wire and a plurality of caddy apertures from which the wire may be dispensed.

BACKGROUND

Electricians typically store and transport electrical wire in a variety of ways, depending on the type and amount of wire they are working with. One common method is to store wire in spools or reels, which can be made of plastic, wood, or metal, depending on the weight and size of the wire. These spools can be transported and stored from a wire dispenser, for example, which allows the electrician to quickly access the wire when needed.

Transporting electrical wire can be a challenging task for electricians due to its weight, size, and potential for damage. The weight and size of wire spools or reels can make it difficult to maneuver, and if not secured properly, the wire can become tangled, causing damage or requiring time-consuming untangling.

Furthermore, electrical wire is susceptible to damage from various factors such as moisture, heat, and abrasion during transport. Improper handling or storage can cause the wire insulation to wear off, which can compromise its safety and performance.

To overcome these challenges, electricians use specialized tools and equipment such as wire carts, dispensers, and containers that provide secure storage and easy transport. These tools help to minimize the risk of damage and ensure that the wire is easily accessible when needed.

Electricians also follow best practices when transporting wire, such as securing it properly in the vehicle or trailer, avoiding exposure to extreme temperatures and moisture, and using protective gear to prevent damage or injury during handling.

The methods and tools used for storing and transporting electrical wire will vary depending on the specific needs of the electrician and the type of wire being used. However, there still exists a need to transport different types of wire, e.g., different gauges in a single container. While wire carts provide the ability to transport different types of wire, they are typically large and cumbersome, making their utilization in confined areas difficult. A single container allowing multiple gauges of wire to be deployed therefrom, while storing the wire in a neat, compact container which is also stackable, is an unmet need in the art. This disclosure solves the aforementioned drawbacks of current electrical wire transport systems and provides new, advantageous features that will be appreciated by electricians and others in similar fields.

SUMMARY

In general, a wire caddy is disclosed. In one exemplary embodiment, the wire caddy is a lightweight, but strong and durable container framework that allows multiple spools of wire to be supported therein. For example, the multiple spools of wire can be supported by a cross-bar within the container framework. The container framework also includes a plurality of apertures, through which wire can be drawn from the spools in a neat and organized manner.

In one exemplary embodiment, a wire caddy assembly includes a storage vessel framework formed of a lightweight, resilient material, the framework including a floor, and first, second, third and fourth wall members extending perpendicularly from the floor. The assembly further includes at least one support feature for supporting a cross bar between opposing first and second walls of the vessel framework, at least one aperture within the third or fourth wall, and a handle grip formed on each of the first, second, third and fourth wall.

In a second exemplary embodiment, a wire caddy assembly includes a storage vessel framework formed of a lightweight, resilient material. The framework includes a floor, and first, second, third and fourth walls extending perpendicularly from an outer perimeter of the floor and oriented to form a rectangular shape. The framework further includes at least one support feature for supporting a cross bar between opposing first and second walls of the vessel framework, at least one aperture within the third or fourth walls, and a handle grip on each of the first, second, third and fourth wall.

In one embodiment, the support feature is a U-shaped channel.

In one embodiment, the cross bar has a cross-sectional diameter sufficient to receive a wire spool thereupon.

In one embodiment, the at least one aperture is configured to allow electrical wire to pass therethrough. In a related embodiment, the wire caddy assembly further includes a surface immediately adjacent to the at least one aperture for identifying the electrical wire. In a related embodiment, the wire caddy assembly further includes a keeper in proximity to the at least one aperture that is configured to receive and hold the electrical wire. The keeper can be a notch having a gap, and the gap can have a width sufficient to frictionally engage the wire.

In one embodiment, the storage vessel framework includes first and second support features that support first and second cross bars, respectively.

In one embodiment, the at least one support feature is configured to allow the cross bar to be inserted and removed by a one-way sliding movement.

In one embodiment, the wire caddy assembly further includes at least two rail protrusions extending vertically from the floor on an opposite floor side from the first, second, third and fourth walls. The at least two rail protrusions can be inset from the outer perimeter of the wall, and a distance between outer surfaces of the at least two rail protrusions can be equal to a distance between the inner surface of the first and second walls. The at least two rail protrusions can allow first and second wire caddys to be stacked on top of one another.

In one embodiment, each of the first, second, third and fourth walls include a handle member for carrying the wire caddy assembly.

In a third exemplary embodiment, a wire caddy assembly includes a container framework. The container framework includes a floor and four walls configured in a cubic shape, first and second support member pairs for supporting first and second cross bars, respectively, wherein each of the first and second cross bars is configured to support at least one spool of electrical wire, and at least three wire apertures within the first and second walls, wherein the first and second walls are diametrically opposed.

In one embodiment, the first and second support members provide a slot into which the cross bar may be inserted. In one embodiment, the first and second support members are U-shaped.

In one embodiment, the wire caddy assembly further includes at least one handle aperture on each of the first, second, third and fourth walls configured as a carrying handle. In one embodiment, the wire caddy assembly further includes at least one wire holder adjacent to each of the at least three wire apertures. The cross bar can have a length sufficient to accommodate at least one spool of electrical wire. In other embodiments, the cross bar can have a length sufficient to accommodate two, three, four, or five spools of electrical wire adjacent one another.

Certain advantages of the systems and methods include the ability to transport multiple spools of wire in a single container; the container itself is smaller than a traditional wire caddy or cart, allowing the user to bring the container into confined spaces without difficulty; wire can be dispensed from the container in a neat and organized fashion, where, for example, a single gauge or type of wire is assigned to separate apertures; among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

BRIEF DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
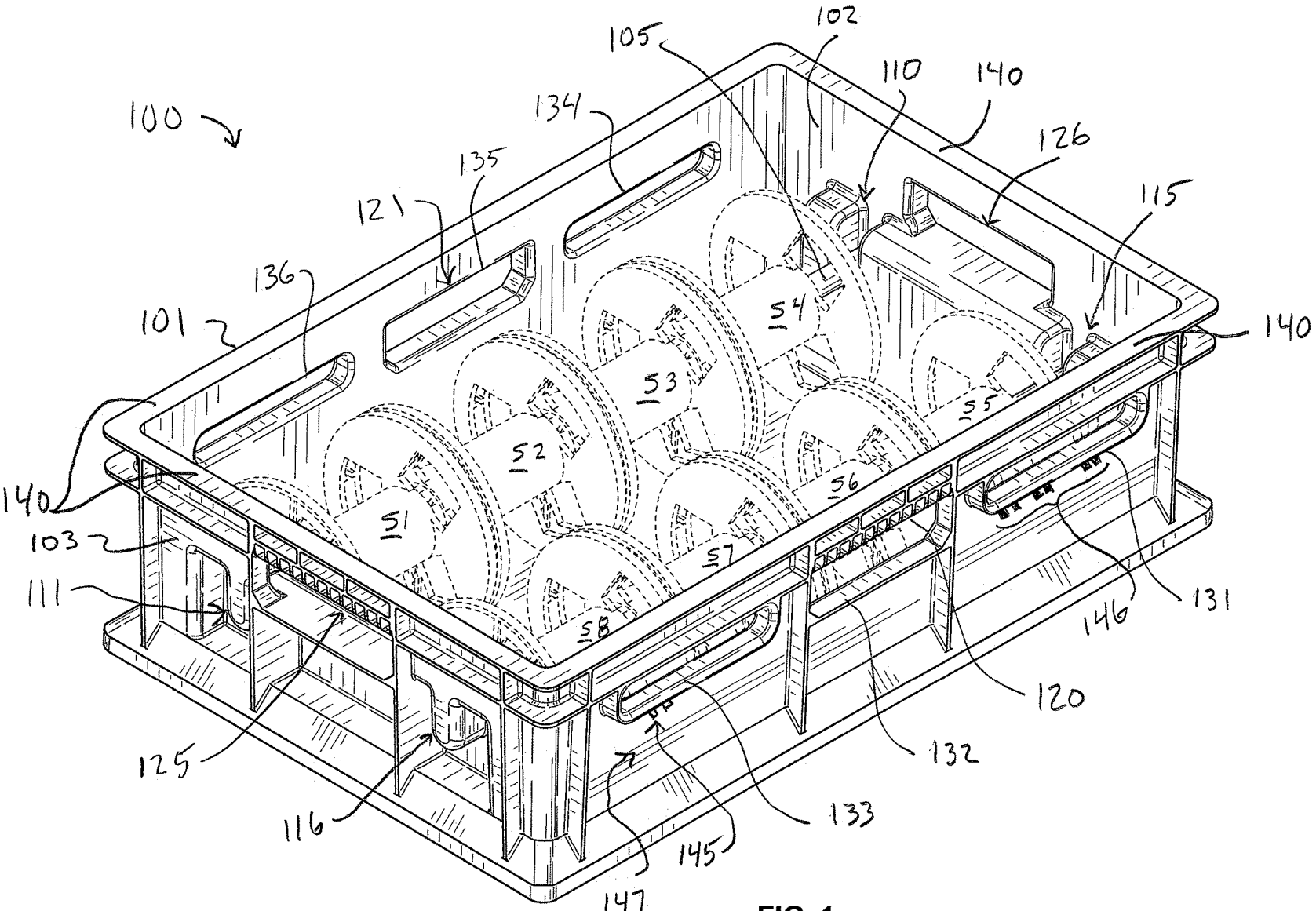
FIG. 1 is a perspective view of a wire caddy according to one embodiment.
Figure 2:
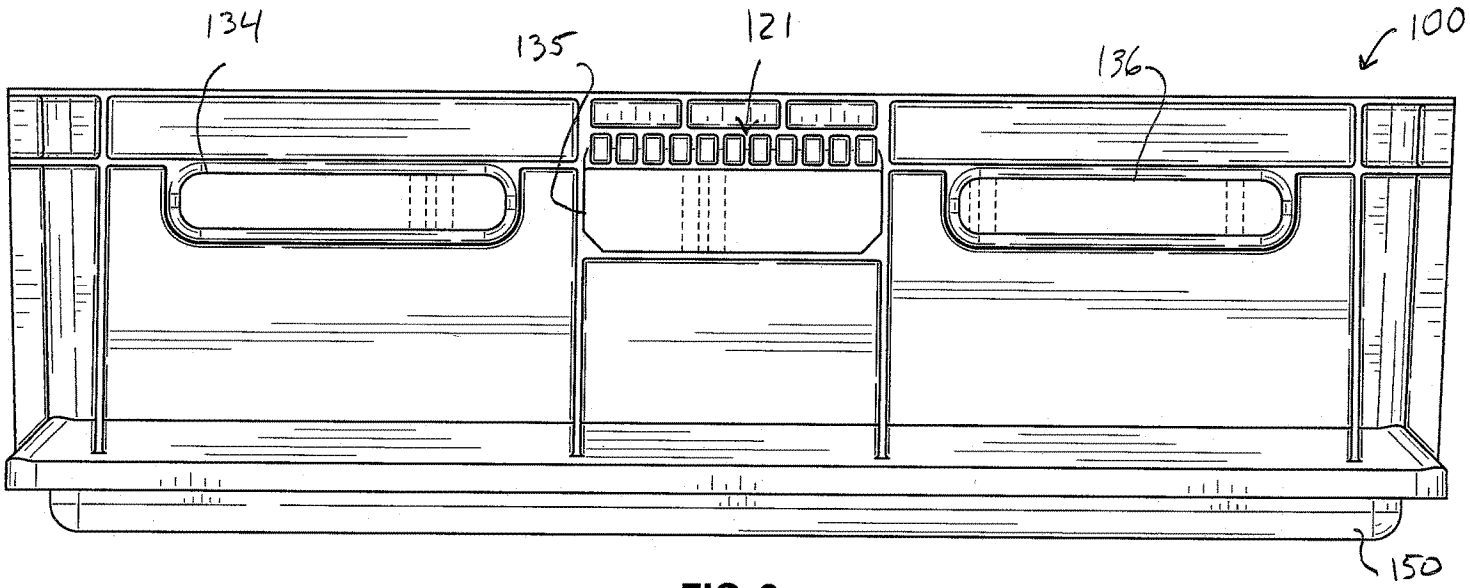
FIG. 2 is a left-side elevation view of the wire caddy of FIG. 1.
Figure 3:
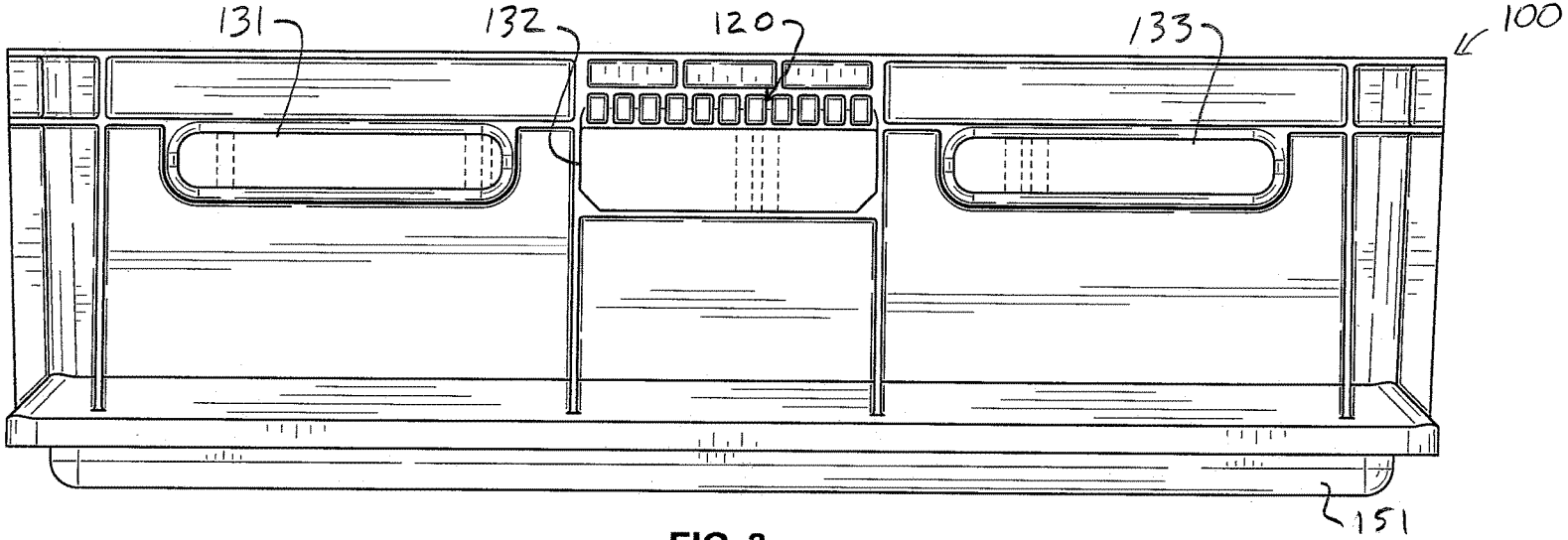
FIG. 3 is a right-side elevation view of the wire caddy of FIG. 1.
Figure 4:
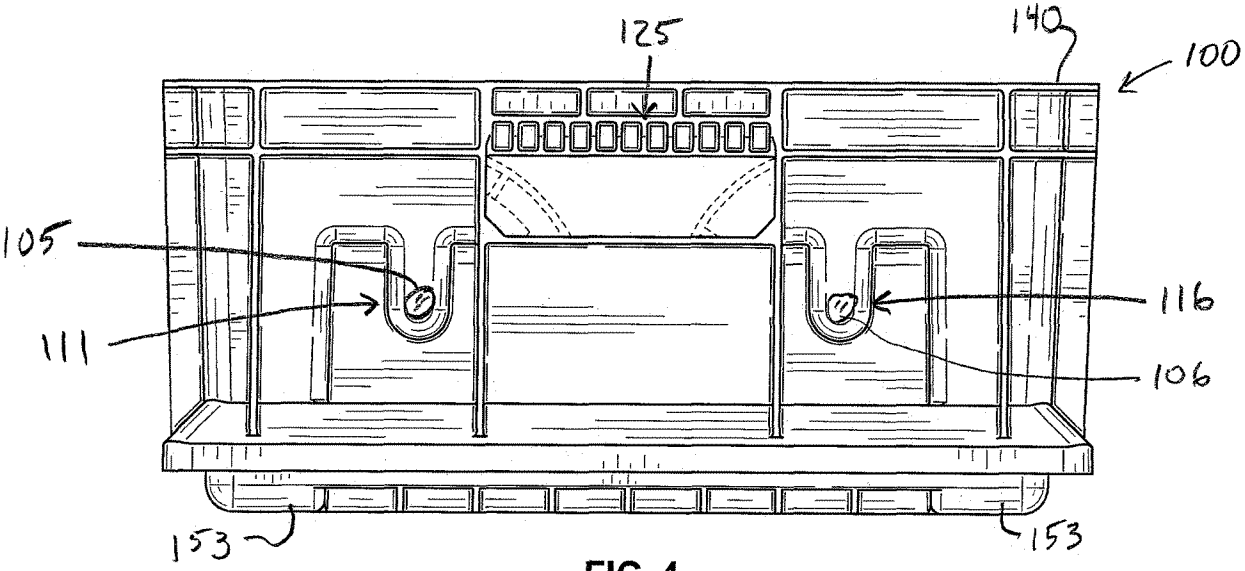
FIG. 4 is a front-side elevation view of the wire caddy of FIG. 1.
Figure 5:
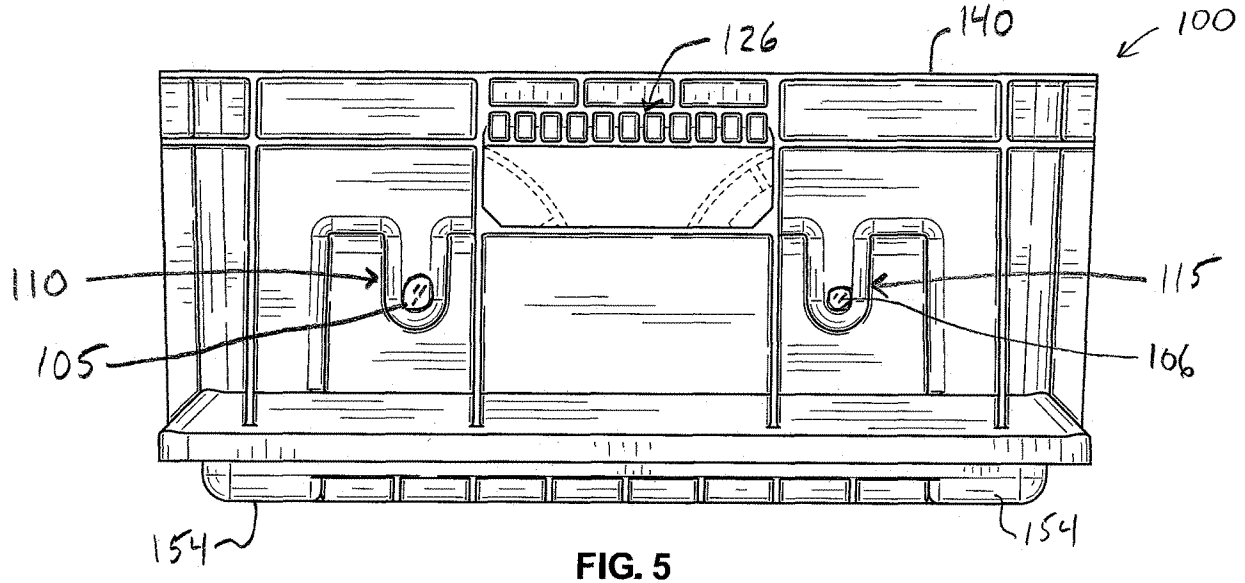
FIG. 5 is a rear-side elevation view of the wire caddy of FIG. 1.

FIG. 1 is a wire caddy 100 according to one embodiment. In this embodiment, the wire caddy 100 includes a container framework 101, preferably formed of a durable yet lightweight plastic material such as, but not limited to high-density polyethylene, Acrylonitrile butadiene styrene, polycarbonate, polyamide-imide, or high impact polystyrene. Because electrical wire spools can be heavy in and of themselves, it can be preferable to utilize a framework material that is both lightweight and possesses a high tensile strength. The framework 101 can be formed by known processes, such as injection molding, 3D-printing or other methods.

Figure 6:
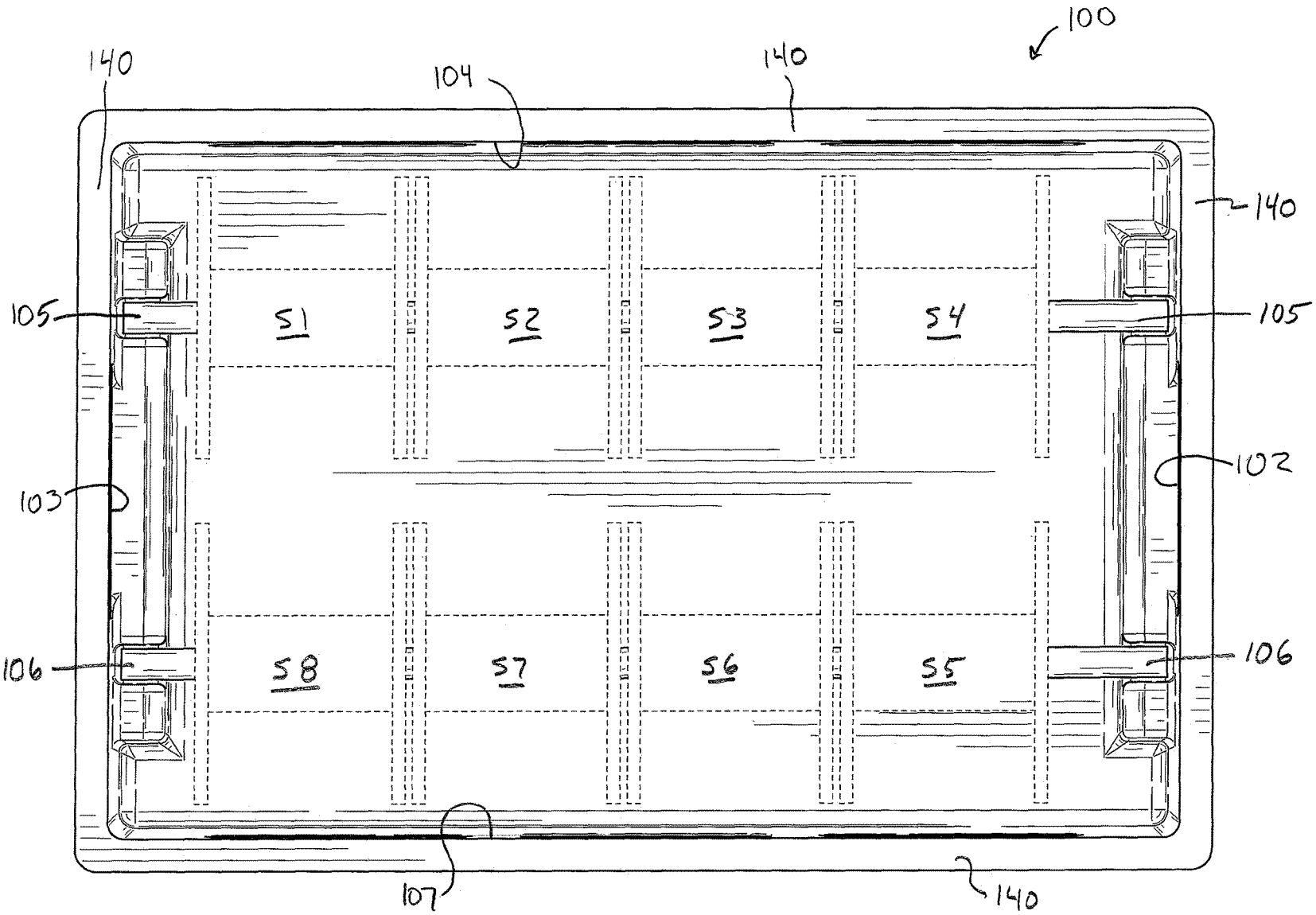
FIG. 6 is a top plan view of the wire caddy of FIG. 1.
Figure 7:
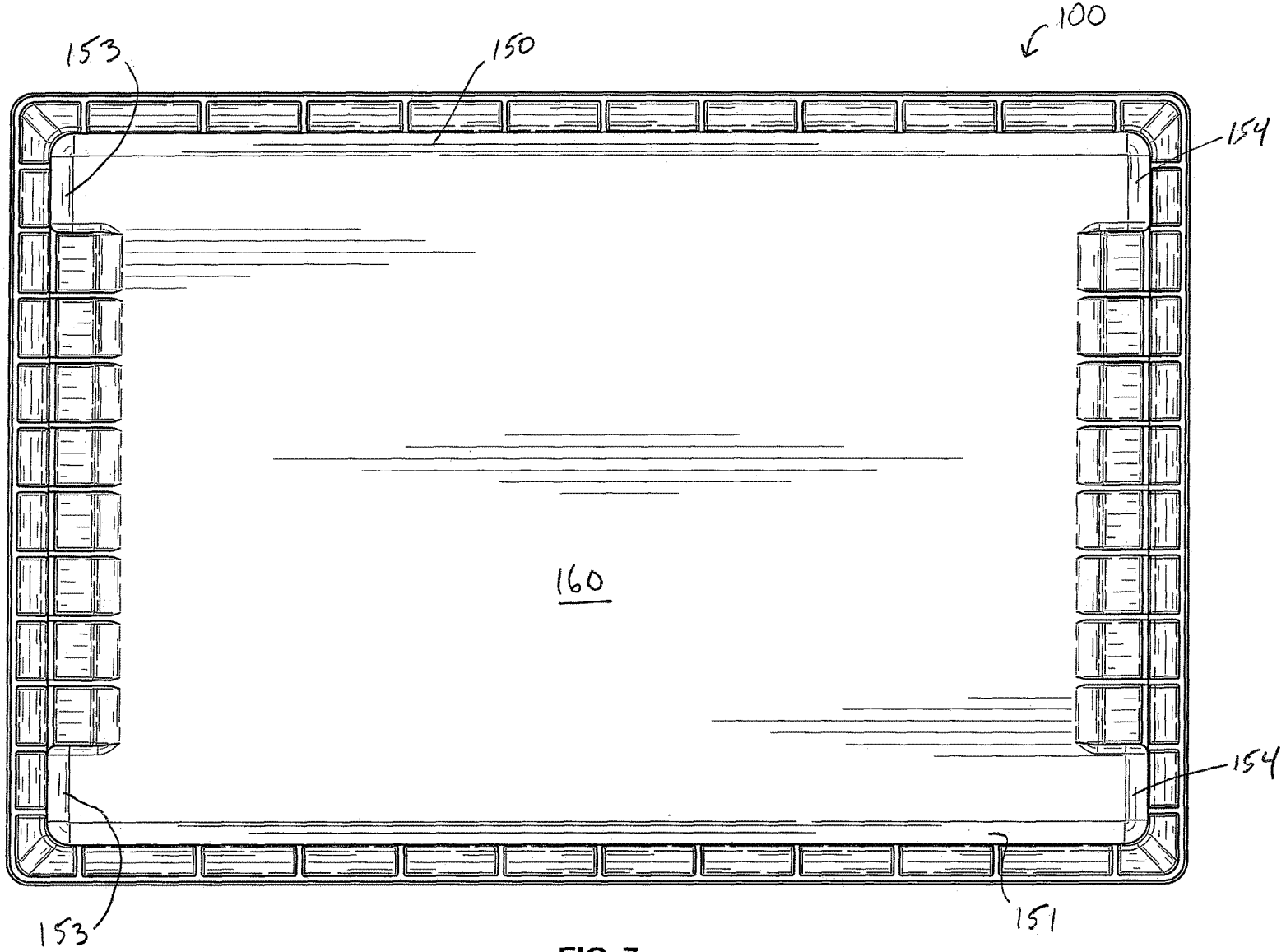
FIG. 7 is a bottom plan view of the wire caddy of FIG. 1.

In this embodiment, the framework 101 includes at least one support feature for supporting a cross bar that holds the electrical spools. In this example, the support feature includes two diametrically-opposed U-shaped protrusion pairs 110, 111 and 115, 116 respectively. Each support is configured to support a bar 105 that extends lengthwise across the framework 101 as exemplified in FIG. 1, e.g., from first wall 102 to a diametrically opposite wall 103. In this example, U-shaped protrusion pair 110, 111 supports bar 105 as depicted. U-shaped protrusions 115, 116 support bar 106 that is not visible in FIG. 1 for figure clarity but is shown in FIG. 6.

In this embodiment, each bar 105 is configured to support at least one spool of electrical wire. In the example of FIG. 1, four spools, S1, S2, S3 and S4 are supported by bar 105. Spools S5, S6, S7 and S8 are supported by bar 106. The spools are illustrated in dashed lines to express that they are not part of the wire caddy 100, but rather are interchangeable components that can be selected by, for example, an electrician and used according to preference.

In this embodiment, the framework 101 includes two pairs of handles for transporting the caddy 100. In this example, a first handle pair is defined by handles 120 and 121; the second handle pair is defined by handles 125 and 126. The handle pairs are orthogonal, allowing the user the choice of carrying the caddy 100 along the long (e.g., from wall 102 to wall 103) or short axis, as preferred.

In this embodiment, the framework 101 includes a plurality of apertures for feeding electrical wire from the spools within the framework to outside the framework. In this example, apertures 134, 135 and 136 are configured to receive electrical wire from spools on the same side, e.g., spools S1, S2, S3 and S4. While three apertures are shown in this example, it should be understood that the framework may include more or fewer apertures. For example, the framework 101 can include a dedicated aperture for each spool. Continuing with the exemplary embodiment of FIG. 1, on the opposite side, apertures 131, 132 and 133 are configured to receive electrical wire from spools S5, S6, S7 and S8.

When removing wire from the caddy 100, the user can pull the desired length of wire through the appropriate aperture and utilize a tool to cut the wire where intended. To keep exposed wire tidy, one or more of the apertures can include a keeper such as notch 145 that is configured to hold a wire end in place after it has been cut. In one embodiment, a plurality of keepers of different keeper widths may be utilized to hold wire of different diameters. For example, aperture 131 includes three notches 146; a first notch may be 1.5 mm in width to hold 14 gauge wire, which is 1.63 mm in diameter according to industry standards. A second notch can be 1.9 mm to hold 12 gauge wire which is 2.05 mm in diameter by industry standards, and a third notch can be 1.40 mm to hold 10 gauge wire which is 2.59 mm in diameter by industry standards. The choice of notch width for a given gauge of wire can be selected according to how tight the wire is intended to be held by the notch. It should be understood that the notch widths disclosed herein are functional for their purpose, but exemplary and non-limiting.

In this embodiment, wire caddys 100 can be stacked securely on top of one another. To achieve this functionality, the bottom portion of each caddy 100 includes inset rails 150, 151, 153 and 154 (FIGS. 2-7). The inset rails extend beyond the bottom surface 160 of the framework 101 as best visualized in FIGS. 2-5. The perimeter of the inset rails is less than that of the top surface 140 and configured such that when one caddy 100 is placed atop the other, the inset rails fit inside the top surface 140 and abut the inside surface of walls 102, 103, 104 and 107 (FIG. 6). In this way, lateral shifting of one caddy 100 relative to another is minimized.

The number of spools that are capable of being stored within the caddy 100 can depend on the spool size and/or the wire gauge. In the present example, the framework 101 is sized to accommodate five spools of 14-gauge wire on each cross bar (105, 106, respectively). However, it should be understood that more or fewer spools may be used according to preference.

The caddy 100 can be used by, e.g., electricians for carrying wire to a job site. In doing so, the user may remove one or all of the cross bars 105, 106 and load them with wire spools needed for their particular job. Preferably, the user will leave an end portion of the cross bar exposed so that the entire assembly of cross bar and spools may be dropped directly into the support features, e.g., U-shaped protrusion pairs 110, 111 and 115, 116. Being able to easily remove the cross bar and spool assemblies can reduce the time and effort necessary to switch out empty spools or replace spools of one gauge for another.

In this embodiment, beneath each aperture is an open wall surface, e.g., area 147 (FIG. 1) that can accommodate a writing surface, or a surface on which to place a sticker or other similar item for the purpose of easily identifying the wire extending through a particular aperture (in this example, aperture 133). Such functionality can be especially useful when utilizing stacked caddys, as the wire spools may be obfuscated from view.

A number of illustrative embodiments have been described. Nevertheless, it will be understood that various modifications may be made without departing from the spirit and scope of the various embodiments presented herein. For example, while the cross-bar support features have been shown and described herein as U-shaped protrusions, other approaches may be utilized, such as, but not limited to upward-facing C-shaped cups, bearings, apertures or other features. The number of apertures used may be modified according to preference, ease of use, types of wire and/or wire spools used, or other considerations. The proportional length and width of the caddy shown in FIGS. 1-7 may be modified to accommodate more or fewer spools than shown and described herein. The choice of framework 101 material may also be chosen according to preference to address features such as caddy weight, tensile strength or other factors. Accordingly, other embodiments are within the scope of the following claims.

What is claimed is:

1. A wire caddy assembly, comprising:

a storage vessel framework formed of a lightweight, resilient material, said framework comprising:

a floor; and a first wall, a second wall, a third wall and a fourth wall extending perpendicularly from an outer perimeter of said floor and oriented to form a rectangular shape;

a cross bar supported by at least one support feature spanning between said first wall and second wall of said vessel framework, said first wall and said second wall being oppositely disposed to one another;

at least one aperture within said third or fourth wall;

a separate handle grip on each of said first wall, said second wall, said third wall and said fourth wall; and at least two rail protrusions extending vertically from said floor on an opposite floor side from said first, second, third and fourth walls.

2. The wire caddy assembly of claim 1, wherein said at least one support feature is a U-shaped channel.

3. The wire caddy assembly of claim 1, wherein said cross bar has a cross-sectional diameter sufficient to receive a wire spool thereupon.

4. The wire caddy assembly of claim 1, wherein said at least one aperture is configured to allow electrical wire to pass therethrough.

5. The wire caddy assembly of claim 4, further comprising a surface immediately adjacent to said at least one aperture for identifying a type of electrical wire.

6. The wire caddy assembly of claim 4, further comprising a keeper in proximity to said at least one aperture that is configured to receive and hold electrical wire.

7. The wire caddy assembly of claim 6, wherein said keeper is a notch having a gap, and wherein said gap has a width sufficient to frictionally engage a portion of electrical wire.

8. The wire caddy assembly of claim 1, wherein said storage vessel framework comprises a second support feature that supports a second cross bar.

9. The wire caddy assembly of claim 1, wherein said at least one support feature is configured to allow said cross bar to be inserted and removed by a one-way sliding movement.

10. The wire caddy assembly of claim 1, wherein said at least two rail protrusions are inset from said outer perimeter of said first wall and said second wall.

11. The wire caddy assembly of claim 10, wherein a distance between outer surfaces of said at least two rail protrusions is equal to a distance between the inner circumferential surface of said first wall and said second wall.

12. The wire caddy assembly of claim 10, wherein said at least two rail protrusions allows a first of said wire caddy assembly and a second of said wire caddies to be stacked.

13. The wire caddy assembly of claim 1, wherein each of said first wall, said second wall, said third wall and fourth wall each comprises a separate handle member for carrying said wire caddy assembly;

wherein said handle member on said first wall is opposite said handle member on said third wall, and wherein said handle member on said second wall is opposite said handle member on said fourth wall, so that said handle members provide symmetrical locations for said wire caddy assembly to be carried.

* * * * *